United States Patent [19]

Legler et al.

[11] Patent Number: 4,972,885

[45] Date of Patent: Nov. 27, 1990

[54] POWER MODULE FOR SPECIAL PURPOSE WOODWORKING TOOLS

[75] Inventors: John G. Legler, Huber Heights; David D. Flora, Arcanum; William J. Schaefer, Jr., Dayton; Steven A. Snyder, Spring Valley, all of Ohio

[73] Assignee: Shopsmith, Inc., Dayton, Ohio

[21] Appl. No.: 389,073

[22] Filed: Aug. 2, 1989

[51] Int. Cl.[5] ..... B27C 9/00

[52] U.S. Cl. ..... 144/1 R; 29/560; 144/1 C; 144/35 R; 408/20

[58] Field of Search ..... 29/560, 560.1; 408/20; 144/1 R, 1 B, 1 D, 1 C, 1 F, 1 J, 35 R

[56] References Cited

U.S. PATENT DOCUMENTS

| | | | |
|---|---|---|---|
| 2,857,717 | 10/1958 | Edgemond, et al. . | |
| 2,927,612 | 3/1960 | Edgemond, Jr. et al. . | |
| 4,515,191 | 5/1985 | Fetty | 29/560 |
| 4,598,744 | 7/1986 | Bons et al. | 29/560 |

OTHER PUBLICATIONS

Drawing of May Tool & Sign Die, Inc., dated Jan. 1987.

Shopsmith, Inc. Bulletin 505641, 12/82.

Shopsmith, Inc. Bulletin 505642, 6/82.

Shopsmith, Inc. Bulletin 505681-B, 1/84.

*Primary Examiner*—W. Donald Bray

*Attorney, Agent, or Firm*—Biebel, French & Nauman

[57] ABSTRACT

A power module for providing power to any one of a plurality of special purpose woodworking tools has a variable speed headstock on a base, and a tool support carriage on the base. The tool support carriage is formed with two pairs of tube-receiving sockets for receiving the support tubes of a special purpose woodworking tool. The sockets are formed at two different levels above the base, such levels corresponding to the difference in spacing of the input shaft connections with respect to the support tubes. The base is mounted for movement toward and away from the headstock, providing alignment of the input shaft with the headstock hub. A variable speed drive in the headstock employs an intermediate three-section pulley of the variator type, and a speed control knob is connected to position the variable speed drive to provide for the selection of speed for any particular tool.

15 Claims, 9 Drawing Sheets

POWER MODULE FOR SPECIAL PURPOSE WOODWORKING TOOLS

BACKGROUND OF THE INVENTION

This invention relates to a universal drive or power module for providing shaft power input to any one of a plurality of different special purpose woodworking tools.

Applicants' assignee, Shopsmith, Inc., has for a number of years, offered a variety of special purpose woodworking tools. Such special purpose tools have been specifically designed for use with the "Mark V" multi-purpose woodworking tool made in accordance with the teachings of U.S. Pat. No. 2,927,612 issued Mar. 8, 1960 to Edgemond, Jr., et al.

The multi-purpose "Mark V" tool as disclosed in the above-identified patent of Edgemond, Jr., et al, itself provides a variety of woodworking capabilities for the serious hobbyist, including table sawing, vertical drilling, horizontal boring, and lathe turning, among other capabilities. In order to expand the use of the basic multi-purpose machine, and to provide a wider range of woodworking capabilities, a series of special purpose woodworking tools has been developed for attachment on and use with the multi-purpose tool. For this purpose the multi-purpose tool was provided with a pair of laterally spaced auxiliary mounting sockets. These sockets were proportioned to receive the laterally spaced eccentric mounting posts of special purpose tools. The headstock was further provided with a pair of auxiliary output drive shafts or hubs for the coupling to the input shafts of such special purpose tools.

The auxiliary drive shafts, defined respectively by reference numerals 164 and 107 in patent '612, were vertically spaced with respect to the elevation of the pair of tube-receiving sockets, and provided the designers of the special purpose tools with a selection of available power inputs at two specific elevational locations. As a result, any given special purpose tool has a power input shaft connection at one or the other of two elevational positions for coupling with one of the multi-purpose power drive shafts, through an intermediate removable shaft connector or coupler.

The special purpose woodworking tools which have been specially designed and developed for use as an adjunct to the multi-purpose woodworking tool shown in patent '612 include, among others, a belt sander as shown in U.S. Pat. No. 2,857,717 issued Oct. 28, 1958, a jointer as represented by the reference number 47 in patent '612, and as further described in Bulletin No. 505681-B of Shopsmith, Inc., a scroll saw as described and claimed in the copening application of Legler et al, Ser. No. 226,172 filed July 29, 1988, a jig saw as described in Bulletin No. 505644, a band saw as described in Bulletin No. 505641, and a belt sander as described in Bulletin No. 505642, all published by Shopsmith, Inc.

Each of these special purpose tools is supported on a pair of depending, laterally spaced-apart mounting posts. The posts are adapted to be received within the postreceiving auxiliary sockets positioned at one end of the multi-purpose woodworking machine.

The depending posts are generally formed with eccentric offsets which permit the respective special purpose tool to be laterally adjusted with respect to the axis of one the output power shafts of the headstock, and then locked in adjusted position.

Since many of the above-defined special purpose tools are, themselves, primary woodworking devices, and since the multi-purpose woodworking machine for which such auxiliary devices have been designed is not otherwise available for its primary functions while it is being used to support and power one of the special purpose tools, a need has arisen for a universal power module which will support and provide variable speed drive power to each of such tools in accordance with its specific requirements. Desirably, such power module should also have an auxiliary output shaft for supporting simple rotary buffers, sanding drums, and the like, for use by the hobbyist apart from or in addition to the principal multi-purpose woodworking machine.

A need also exists for such a universal power module which is both simple and reliable in construction, one which can be manufactured at relatively modest cost, and which inherently provides the necessary mounting precision required for utilization of the full potential of the line of special purpose tools, as described above.

SUMMARY OF THE INVENTION

This invention relates to a compact power stand or power module for special purpose woodworking tools, and more particularly to such a stand incorporating a variable speed headstock, and a transversely movable carriage adapted to receive and support the depending mounting posts of such special purpose tools, so that the power input shaft of any such tool is in proper alignment with an output spindle on the headstock. The power module of this invention includes a carriage which is mounted for sliding movement on an elevated base. The carriage is formed with two separate pairs of tube-receiving sockets. One of such pair of sockets is elevated and vertically offset with respect to the other of such pair of sockets. The socket pairs are positioned with respect to an output spindle hub to assure axial alignment with the power input shaft of an associated special purpose woodworking tool.

The output shaft, in the headstock, is provided with a primary drive hub at one end and with an auxiliary coaxial accessory drive at its opposite end. The auxiliary drive end provides a means for supporting one of a number of additional accessories, so as to permit the power module to perform two functions at one time. Thus, the auxiliary spindle drive may be used to support a drum sander, a flutter sheet sander, or a flexible power shaft, as examples.

The headstock spindle shaft is driven by means of a compact and simplified variable speed drive from a drive motor mounted immediately beneath the base. The variable speed drive advantageously employs a pair of infinitely adjustable pulleys mounted on an intermediate trackway, the position of which is externally adjustable through a rack and pinion arrangement. Speed control may thus be selected at the headstock by a hand-operated speed selector which rotates a spur gear in mesh with a rack gear to cause a translation of the axis of the adjustable twin pulleys toward or away from one or the other of a pair of secondary pulleys, to effect speed adjustments. It is accordingly an important object of this invention to provide a central power unit or module for operating any one of a plurality of special purpose woodworking tools.

Another object of the invention is the provision of a power module characterized by simplicity of design and compactness of size.

A still further object of the invention is the provision of a power stand for woodworking tools, which stand is provided with a carriage adapted to support such tools in at least two different elevational positions with respect to a variable speed drive shaft.

Another object of the invention is the provision of a power module, as outlined above, having a pair of shaft outputs for a variety of simultaneous woodworking operations.

These and other objects and advantages of the invention will be apparent from the following description, the accompanying drawings, and the appended claims.

BRIEF DESCRIPTION OF THE ACCOMPANYING DRAWINGS

DESCRIPTION OF PREFERRED EMBODIMENT

Figure 2:
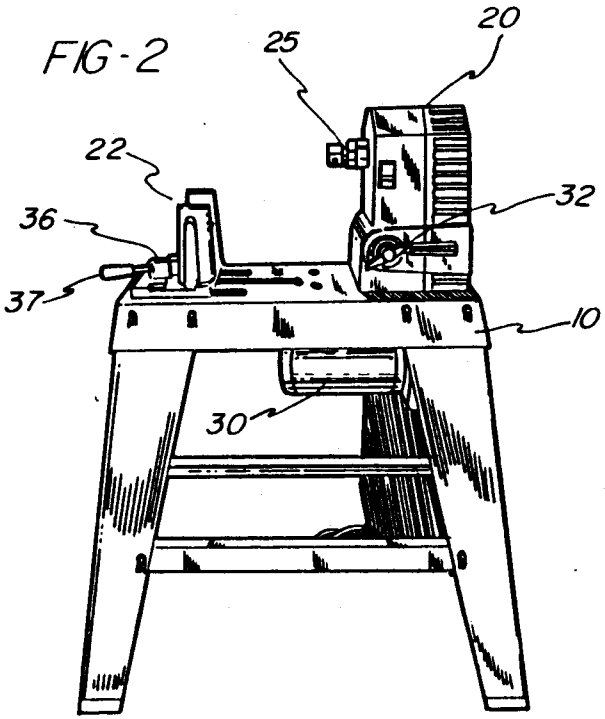
FIG. 2 is a side elevation of the power module.
Figure 1:
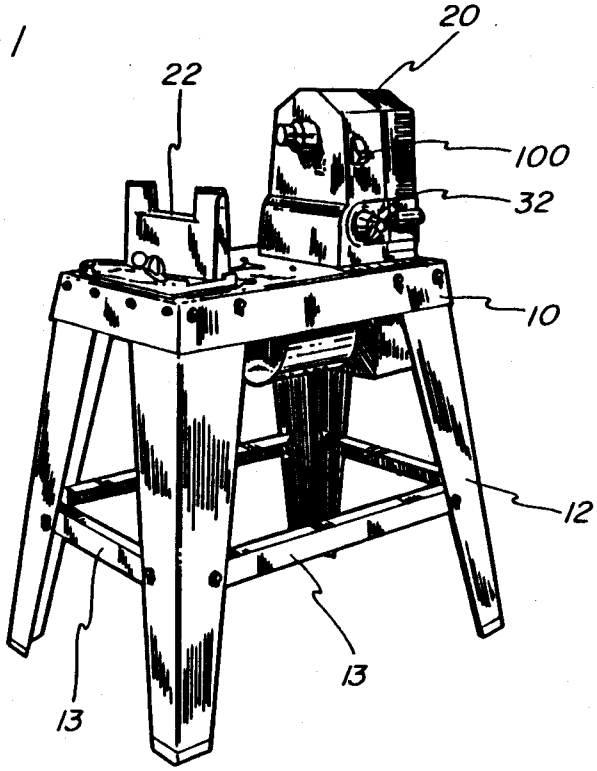
FIG. 1 is a perspective view of a power module in accordance with this invention.

Referring to the drawings, which illustrate a preferred embodiment of the invention, a compact multipurpose power stand or power module in accordance with this invention is shown in FIGS. 1 and 2 as including a base 10 supported on depending legs 12. The legs are reinforced by braces 13.

The base 10, formed of metal, supports a housing or headstock 20 at one end and slidably supports a carriage 22 at the other end. The headstock 20 includes a power output hub generally indicated at 25, and is driven by a motor 30 mounted beneath the base 10. A variable speed control 32 is positioned on the side of the headstock and is operable for controlling the spindle shaft speed, in accordance with an infinitely variable belt and pulley arrangement.

Figure 3:
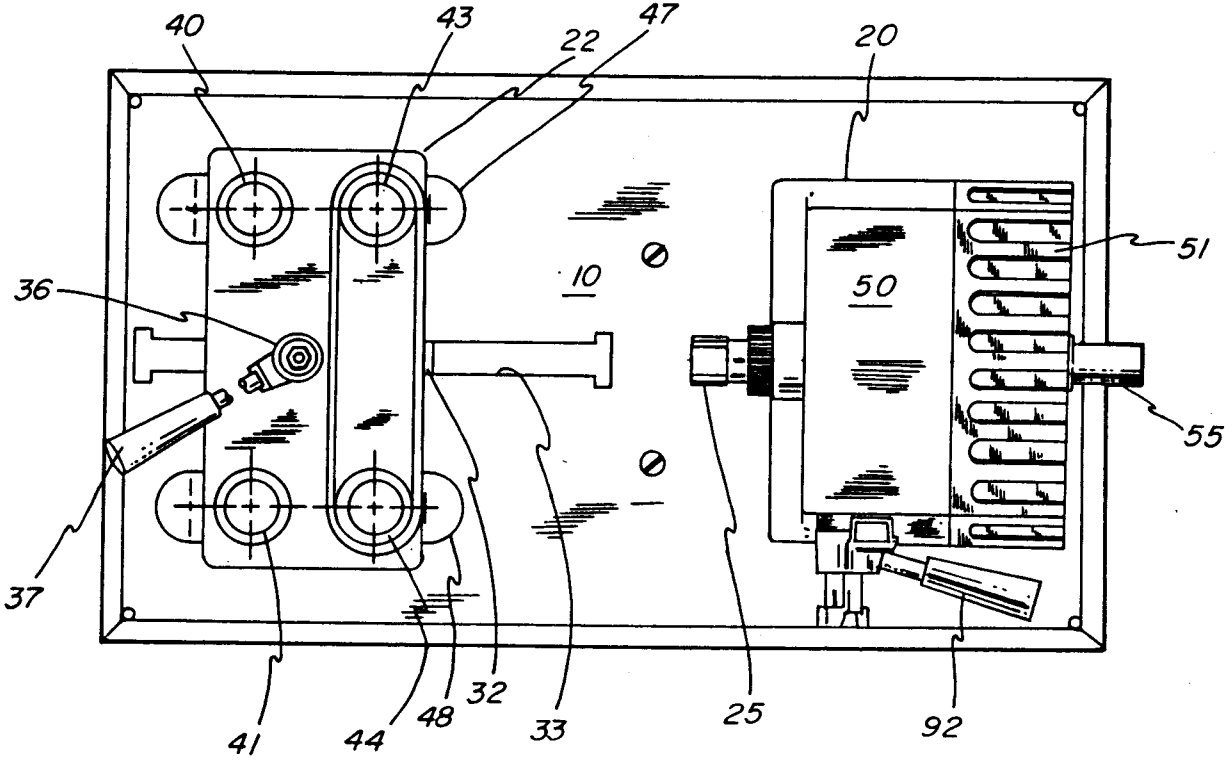
FIG. 3 is an enlarged plan view showing the relationship of the carriage to the headstock.
Figure 6:
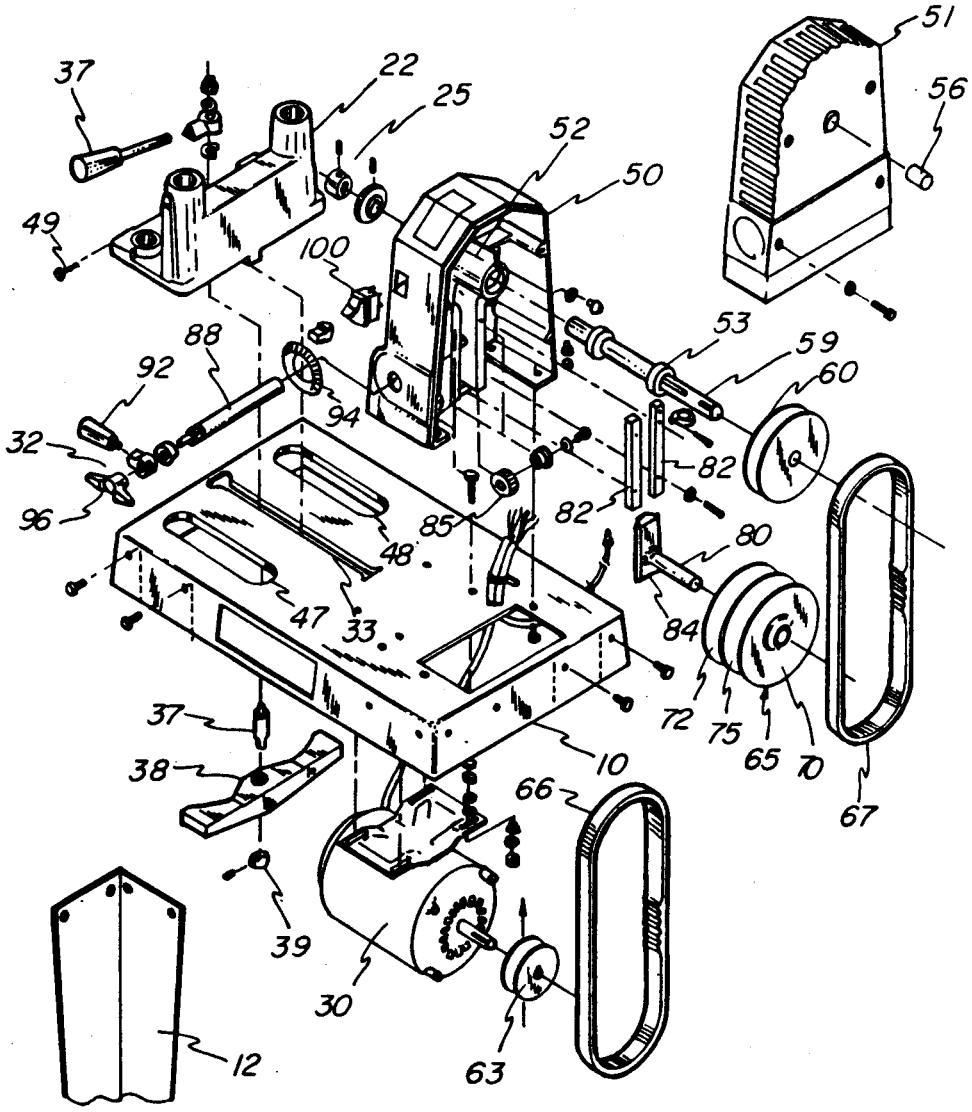
FIG. 6 is an exploded view of the power module, with the legs removed.

As best shown in FIGS. 2 and 3, the carriage 22 is mounted and guided for transverse sliding movement on the upper surface of the base 10, toward and away from the headstock 20. For this purpose, the carriage 22 is provided with a transversely extending key 32 received within a key-receiving slot 33 in the base to assure straight line movement and to maintain proper orientation of the carriage 22. The carriage 22 is clamped in adjusted position by a quarter-turn clamp mechanism 36 including an operator handle 37, as shown in FIGS. 1–3. The clamp mechanism 36 has a clamp shaft 37 which extends to a transversely oriented clamping bar 38 and wedge piece 39, as best shown in FIG. 6, positioned beneath the base 10. The clamping mechanism 36 is of the fast lead or partial turn-closing clamping wedge type so that only about one-quarter turn of the operating handle 37 is necessary for either clamping or releasing the carriage 22 with respect to the base 10.

The carriage 22 is provided with means defining two pairs of vertically-oriented, tube-receiving sockets. These sockets include a first pair identified at 40 and 41 at opposite sides of the slot 33, in FIG. 3, and a second pair of transversely oriented sockets identified at 43 and 44 in FIG. 3, alongside the first pair. The second pair of sockets terminate in upper surfaces which are elevated substantially above those of the first pair. This difference in elevation, between the first and the second pair of sockets, corresponds generally to the difference in elevation between the vertical positions of the input shafts of the special purpose woodworking tools to be carried by the carriage 22, as previously defined.

When a tool is received on the carriage 22 in the lower tube-receiving openings 40 and 41, it is necessary that a lower portion of the mounting tubes extend through the respective tube-receiving sockets and the base 10. For this purpose, the base 10 is provided with a corresponding pair of clearance openings or slots 47, 48, through which the lower ends of the mounting tubes may extend without interference when installed on the carriage 22.

Figure 4:
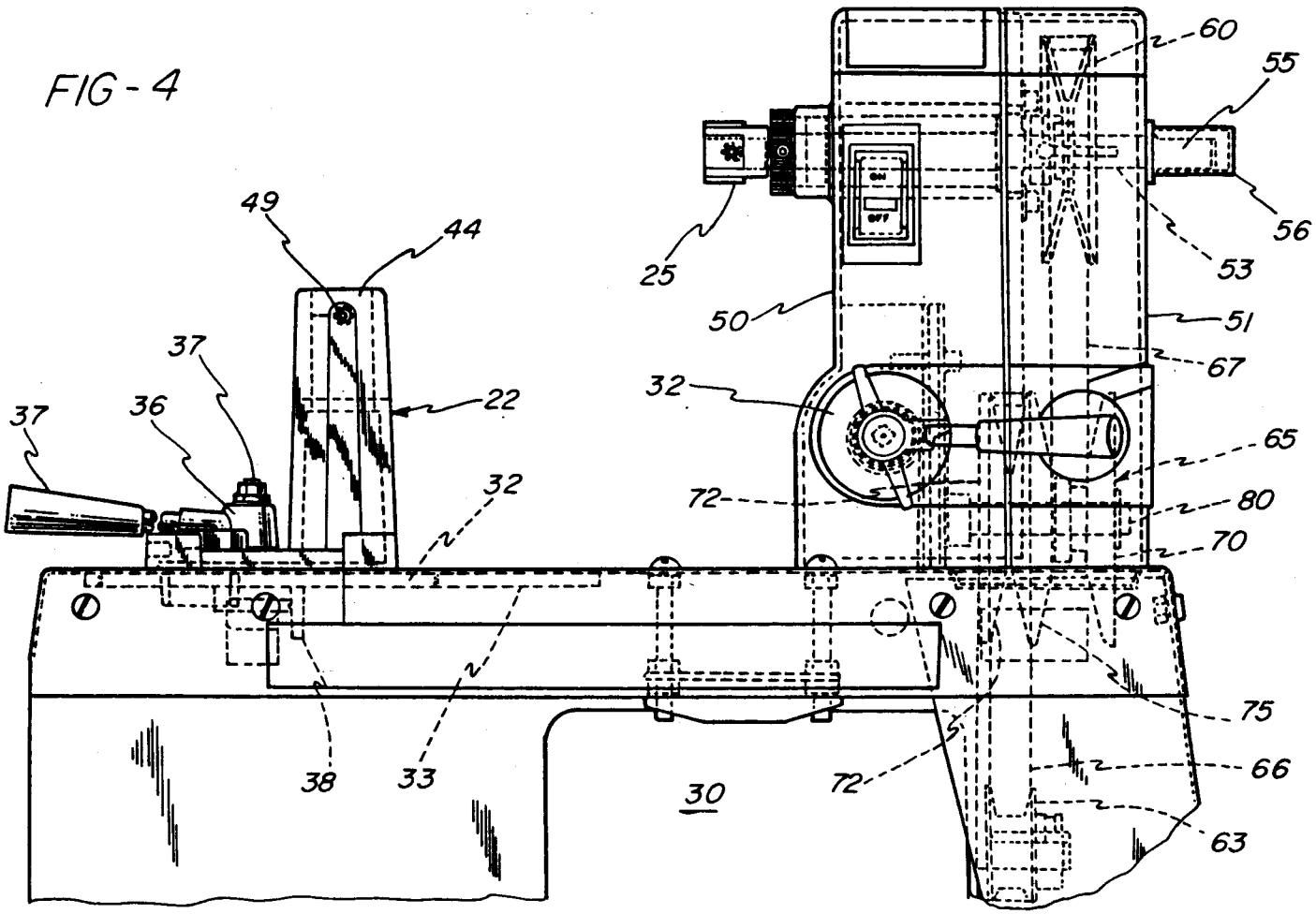
FIG. 4 is a side elevation of the base, and showing in phantom the drive connection between the motor and the spindle.
Figure 5:
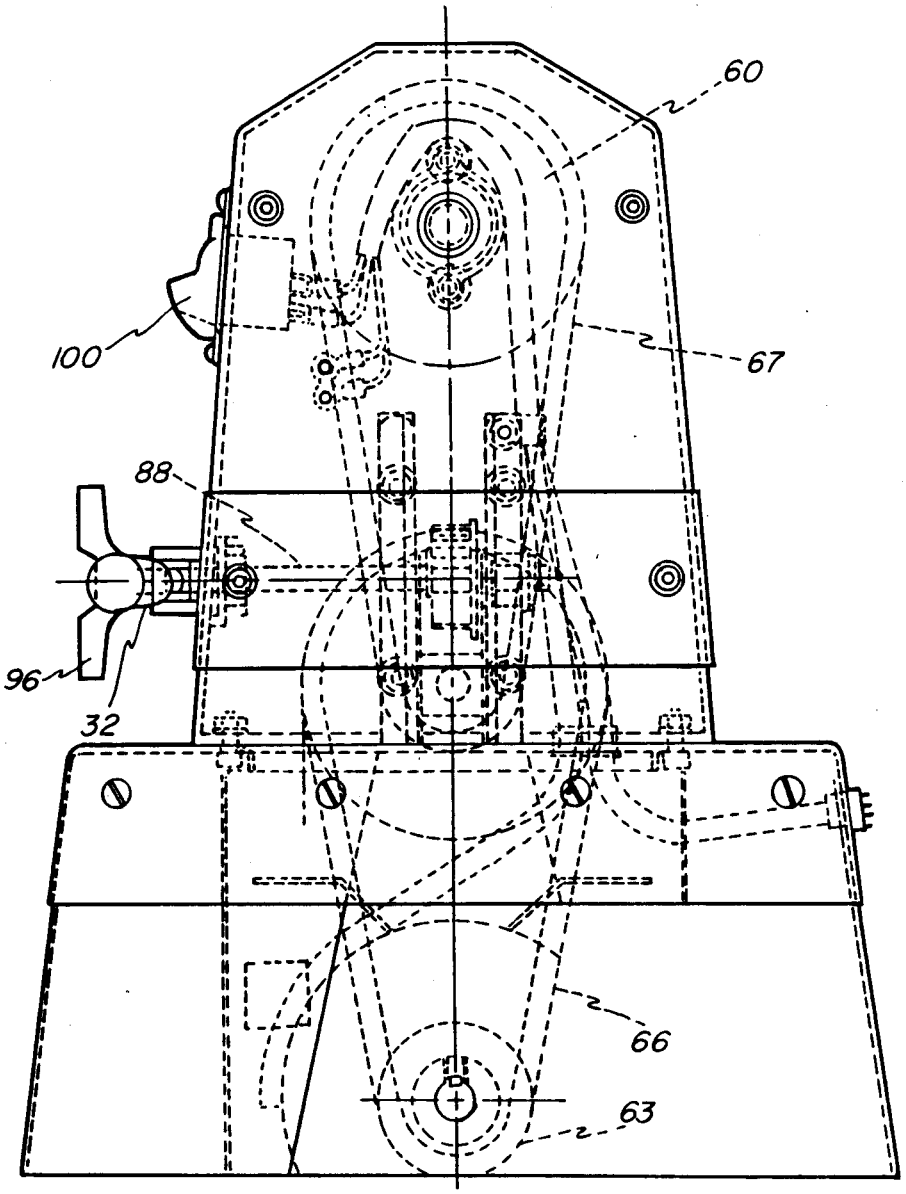
FIG. 5 is an end elevation of the base also showing, in phantom, portions of the drive connection.

The carriage 22, at each of the respective bosses forming the openings 40, 41, 43, 44, is provided with set screws, as shown at 49 in FIGS. 4 and 6 for the purpose of engaging the mounting tubes of the special purpose tool. The set screws are used to clamp the tube in a predetermined elevated position on the carriage, to provide for accurate shaft alignment, and further, to hold an angular or adjusted position of the eccentric mounting tubes, as the case may be.

The spindle head or headstock 20 is shown in FIGS. 3 and 6 as divided into two parts, a main housing 50 and a mating cover 512. The main housing 50 includes an internal boss 52 which rotatably supports the shaft 53 of the spindle hub 25. As best shown in FIG. 6, the shaft 53 is mounted in the boss 52 on spaced bearings, and an auxiliary or accessory portion 55 of the shaft 53 extends through the housing cover 51 and is accessible for the application of auxiliary devices, such as flutter sanders or drum sanders or the like. The auxiliary portion 55 is preferably covered by a protection cap 56 when not in use.

As previously noted, the spindle shaft 53 is driven by the electric motor 30 through an infinitely variable speed belt and pulley drive. For this purpose, the spindle shaft 53 supports a sheet metal shive 60 intermediate its ends and inwardly of the housing cover 51, as shown in FIG. 4. The electric drive motor 30 similar supports a drive pulley 63 in lateral offset relation to the position of the sheet metal shive 60.

An intermediate three-part, two-pulley variable diameter drive 65 connects the drive pulley 63 with the shive 60 through a pair of identical speed selector belts 66 and 67. The variable speed drive conventionally employs a pair of outer shive walls 70 and 72 and an intermediate double-sided floating wall 75. The shive walls 70, 72 and 75, are mounted for rotation on a common support spindle 80. The respective diameters of the pulleys defined between the outer relatively fixed shive walls 70 and 72 and the center floating or adjustable wall section 75 are determined by the relative vertical position of the spindle 80 with respect to the pulleys 60 and 63, in the manner as is conventional with variable diameter pulleys of the "variator" type as known in the art.

Means for selecting the speed of the output spindle shaft 53 with respect to the speed of the motor 60, by suitably adjusting the support spindle 80, includes a pair of guide blocks 82, 83, mounted on suitable support bosses within the main housing 50. The guide blocks are vertically grooved, on their interfacing surfaces, to receive a vertically extending rack portion 84 therebetween. The portion 84 forms an integral part of the spindle 80, with the rack gear facing inwardly into the housing 50. A pinion gear 85 mounted on the inner end of a square input shaft 88 of the speed selector 32 is in constant engagement with the vertical rack portion 84, such that rotation of the pinion gear 85 causes corresponding vertical translation of the rack portion 84 in the guide blocks 82, 83, and vertical movement of the support shaft 80 during speed selection.

The speed selector 52, as best shown in FIG. 6, includes an external drive handle 92 mounted on the end of the shaft 88, and a speed selector dial 94 mounted on an outer surface of the housing 50. The adjusted position of the speed change shaft may be fixed by a wing-shaped clamp nut 96.

A safety-type or guarded on/off switch 100 is conveniently mounted on the face of the housing 50 for controlling power to the motor 30. It is preferable that all speed change adjustments only be made while the motor is operating in order to prevent damage to the speed change mechanism.

Figure 7:
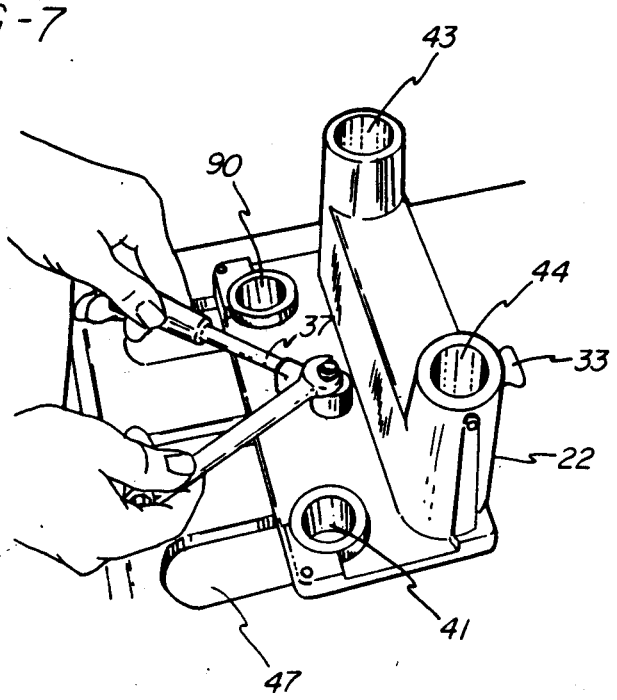
FIG. 7 is a fragmentary view of the base and carriage thereon showing its adjustment in transverse position on the base.

As previously noted, the power module permits installation of a wide variety of special purpose woodworking tools, for variable speed power driving, through the external hub 25 of the output shaft 53. For this purpose, reference may be had to the pictorial views 7 through 14 which illustrate the versatility of the invention. As shown in FIG. 7, the carriage 22 is being positioned along its track defined by the slot 33, and clamped in position by the handle 37. Thereafter, it may be locked in position by the tightening of the top lock nut by a suitable wrench, as shown.

Figure 8:
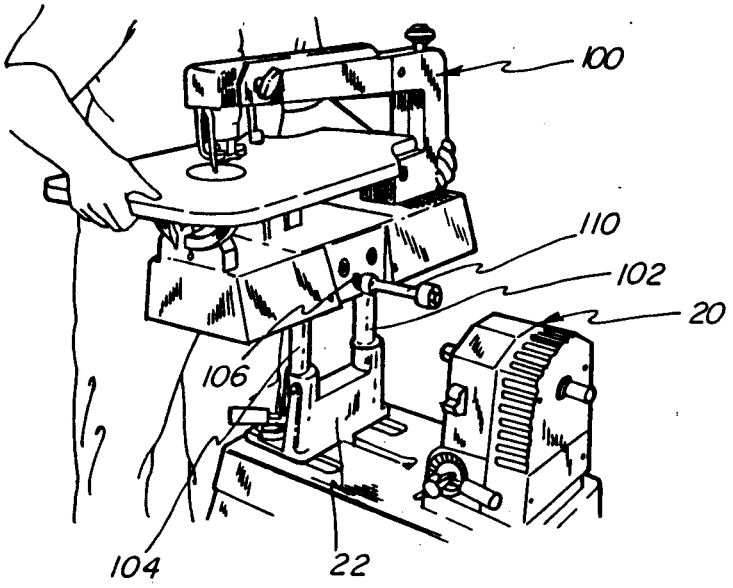
FIG. 8 is a pictorial view showing the positioning of a special purpose tool in the form of a jig saw on the carriage.

In FIG. 8, a special purpose tool in the form of a scroll saw is shown with a scroll saw 100 with its depending eccentrically mounted tubes 102 and 104 is about to be received in the upper pair of tube-receiving openings 43 and 44 of the carriage 22. The power input shaft 106 is shown as extending forwardly toward the headstock 20, with the drive coupler 110 attached. In preparation, the carriage 22 is moved to the left away from the hub 25 to provide clearance. After the special purpose tool is in place, the carriage and tool are moved together for engaging the drive coupler 110.

Figure 10:
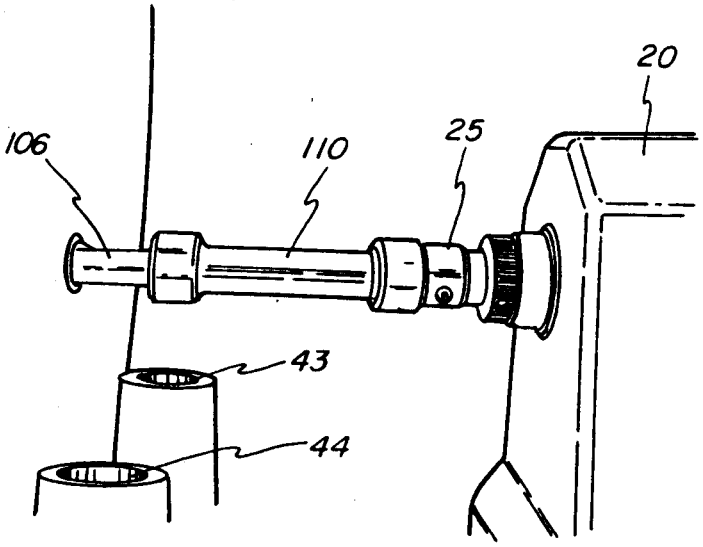
FIG. 10 is a fragmentary side elevation showing a typical coupling of the input shaft of a special purpose tool with the output shaft of the spindle head, employing a removable shaft connector.

In FIG. 10 a typical connection using the removable coupler 110 is shown, extending between the output spindle 25 and a typical input shaft 106 of a woodworking tool. The coupler is a short shaft section as previously used to transmit power from the hubs of the multi-purpose tool of patent '612 and is formed with female sockets at its ends for engagement with the respective hubs.

Figure 9:
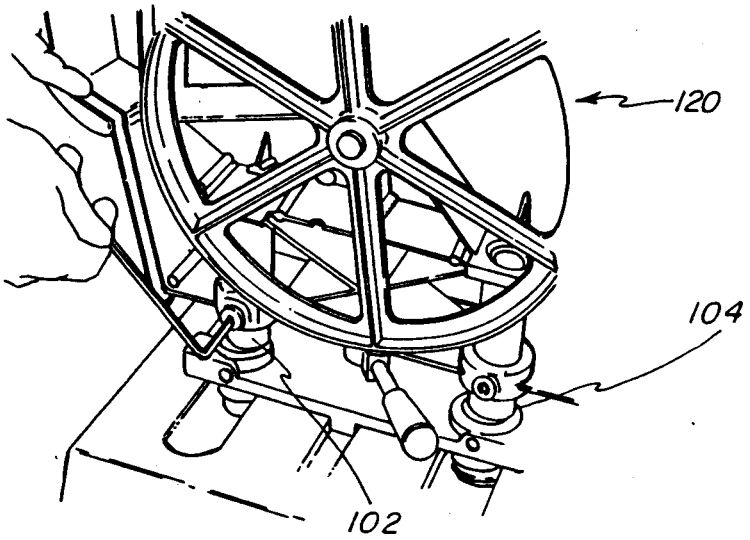
FIG. 9 is another pictorial view showing the positioning and locating of a band saw on the carriage, in which the lower carriage openings are employed.

As previously mentioned, a number of the accessory woodworking tools have been adapted for connection with the lower shaft rather than the upper shaft of the multi-purpose woodworking machine shown in patent '612. When, such tools are used with the present invention, they have their eccentric mounting tubes received in the lower pair of the opening bosses 40 and 41. One such tool is the band saw 120 shown in FIG. 9. In this view, the locking set screw on the saw 120 is being tightened to provide for the holding of the saw 120 in a predetermined adjusted position on the carriage 22. The eccentric tubes 102, 104 may be positioned both vertically and rotationally as necessary to bring the input shaft and the coupler 110 into its proper alignment, as shown in FIG. 10.

Figure 11:
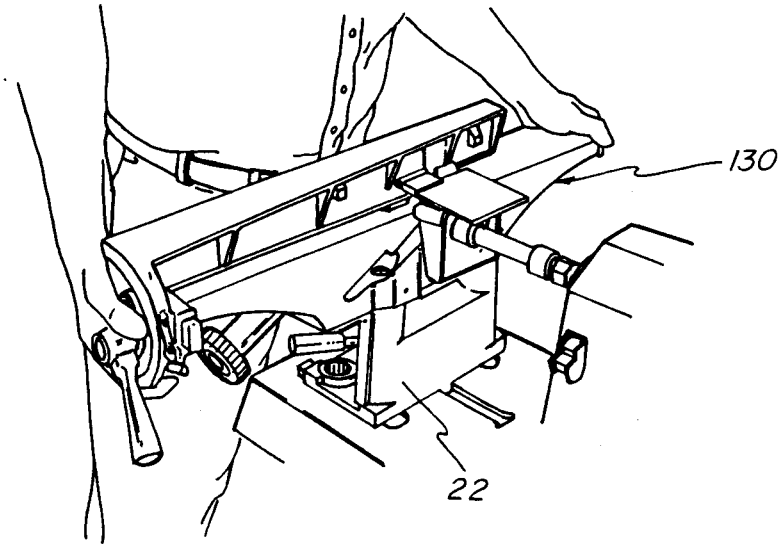
FIG. 11 is a further pictorial view showing the positioning of a jointer on the carriage.

The pictorial view of FIG. 11 shows a jointer 130 after it has been mounted on the carriage 22, and the removable coupling shaft 110 installed in place. The jointer 130 is ready to be moved on the carriage 22 to engage the hub 25 with the coupler 110.

Figure 12:
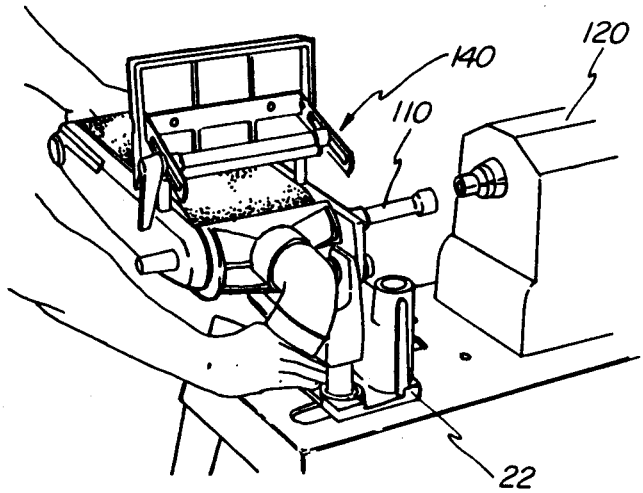
FIG. 12 is a view, similar to FIG. 11, showing the location of a band saw on the carriage.

In the pictorial view of FIG. 12, a belt sander in accordance with the previously identified U.S. Pat. No. 2,857,717 is being mounted lower pocket openings 40, 41 of the carriage 22. After such mounting, the carriage 22 will again be moved so as to bring the removable coupler shaft 110 into engagement with the drive shaft hub 25.

Figure 13:
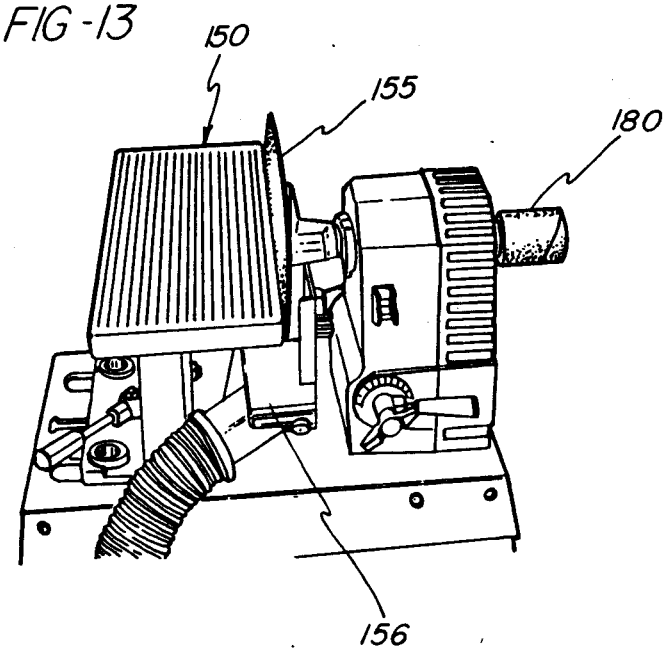
FIG. 13 is a pictorial view of a sanding disc mounted on the output hub of the head, with a table mounted on the carriage, and with a sanding drum mounted on the auxiliary output shaft.

The power module of this invention is also usable with accessories where it is desired to mount a table such as the table 150, of FIG. 13. Table 150 is mounted on the carriage 22 by extending its mounting tubes into the elevated openings 43, 44. A disc-type sander, including a sanding disc 152 and a dust catcher 158, are mounted on the headstock 20. The dust catcher 158 may be made in accordance with the patent of Legler et al, D-292L407 issued Oct. 20, 1987.

Figure 14:
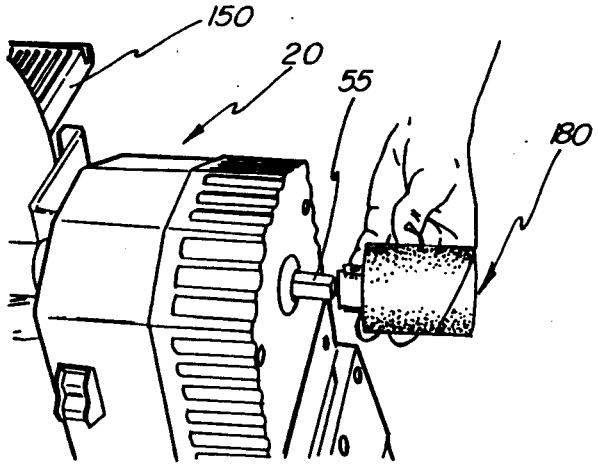
FIG. 14 is a pictorial view showing the mounting of 25 an accessory, such as a sanding drum, on the output shaft.

FIGS. 13 and 14 also illustrate one typical use of the auxiliary shaft extension 55, in the form of a small sander drum 180. The sander drum is simply mounted on a mounting flat forming part of the auxiliary shaft, after the removal of the protective cover 56. Other auxiliary tools may be used, such as a flutter sheet sander, by first mounting a conventional drill chuck on the auxiliary extension shaft. Similarly, a flexible extension shaft may be used by connection to the auxiliary shaft 55 as required.

It will therefore be seen that this invention provides a compact power module for driving a variety of existing special purpose woodworking tools. The speed selection may be made through the speed change mechanism, as previously described, to accommodate the desired or preferred drive speed or speed range of the particular tools involved. Such a speed range may, for example, extend between a minimum of 850 rpm up to a maximum of over 3,600 rpm, through the infinitely variable speed pulley drive 65, previously described. The simple quarter-turn clamp, including the clamp handle 37 and the transversely extending clamping bar 38 assures positive positioning of the carriage 22 on the base 10.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A power module for providing the motive power to a plurality of special purpose woodworking tools, in which each said tool has a power input shaft connection and a pair of mounting posts adapted to be received in tool mounting sockets of a multi-purpose woodworking machine comprising:

a base, a variable speed power head including a headstock mounted in stationary relationship to said base, said headstock having an output shaft spindle mounted for rotation about an axis;

a tool supporting carriage, said carriage having means thereon defining a first pair of tube-receiving sockets and means defining a key extending from said carriage, means mounting said carriage on said base for movement toward and away from said headstock providing for the alignment of the input shaft connection with the output shaft spindle of said headstock, and said means mounting said carriage including means defining a slot in said base extending along a line substantially parallel to the output shaft axis for receiving and guiding said key during movement of said carriage.

2. The power module of claim 1 further comprising a second output shaft spindle on said headstock positioned as an axial extension of the first said output shaft spindle for driving auxiliary woodworking tools.

3. The power module of claim 1 further comprising clamp means between said carriage and said base for clamping said carriage at predetermined adjusted positions along said slot.

4. The power module of claim 1 further comprising an electric drive motor, means mounting said drive motor on said base, a first pulley on said drive motor, a second pulley on said output shaft in said headstock, in driving relation to said spindle and an intermediate pair of infinitely variable spaced pulleys, on each belt coupled to one of said first and second pulleys, means mounting said pulleys on a common shaft, said mounting means including a pair of generally vertically extending guideways in said headstock, rack means in said guideways for generally vertical movement, and externally accessible speed adjusting means including a pinion gear engageable with said rack means for effecting vertical adjustment thereof with respect to said first and second pulleys.

5. A power module for providing the motive power to any one of a plurality of special purpose woodworking tools, in which each said tools have power input shaft connections and each have a pair of depending mounting posts adapted to be received in sockets of a multi-purpose woodworking tool, and in which said power input shaft connections are positioned at either one of a pair of two differing elevations with respect to said posts depending on the particular special purpose tool, comprising:

a base, a carriage, said carriage having means thereon defining two pairs of tube-receiving sockets, said tube sockets terminating at two different elevational levels above said base corresponding to the difference in spacing of the said input shaft connections of said special purpose working tools in relation to the respective said mounting posts, and means mounting said carriage on said base for translational movement toward and away from said power head, and means on said power head forming a power output shaft extending toward said carriage for coupling with an input shaft connection of a special purpose tool.

6. A power module for providing the motive power to a plurality of special purpose woodworking tools, in which each said tool has a power input shaft connection and a pair of mounting posts adapted to be received in tool mounting sockets of a multi-purpose woodworking machine, and in which said power input shaft connection of said tools are positioned at one of two different elevations above said posts depending on the particular special purpose tool, comprising:

a base, a variable speed power head including a headstock on said base, said headstock having an output shaft, a tool supporting carriage, said carriage having means thereon defining two pairs of tube-receiving sockets, said tube sockets being formed on said carriage such that said pairs of tube sockets terminate at two different elevations above said base corresponding to the difference in spacing of the said input shaft connections of said special purpose working tools in relation to the respective said mounting posts, and means mounting said carriage on said base for translational movement toward and away from said headstock providing for the alignment of the input shaft connection with the output shaft of said headstock.

7. The power module of claim 6 further comprising a drive motor on said base, a first pulley on said drive motor, a second pulley on said output shaft, an intermediate pair of variable spaced pulleys mounted on a common spindle, said mounting means including a pair of generally vertically extending guideways, spindle rack means mounted in said guideways for generally vertical movement, and externally accessible speed adjusting means including a pinion gear engageable with said rack means for effecting vertical adjustment thereof.

8. The power module of claim 1 further comprising a second pair of tube-receiving sockets spaced from said first pair of sockets along the direction of carriage movement, said first and second pairs of sockets being oriented substantially transversely to the direction of carriage movement.

9. The power module of claim 8 wherein said first pair of sockets terminate at a first elevation relative to said base and said second pair of sockets terminate at a second elevation relative to said base different from said first elevation.

10. The power module of claim 1 wherein said base includes an upper surface and said carriage is supported for movement on said upper surface.

11. The power module of claim 1 further comprising means defining a pair of slots in said base extending substantially parallel to said direction of carriage movement and aligned with said sockets to provide clearance for the mounting posts of tools mounted in said sockets whereby the mounting posts may pass through said base.

12. The power module of claim 11 wherein said slot for receiving said key is located between said pair of slots aligned with said sockets.

13. The power module of claim 5 wherein said base includes an upper surface and said carriage is supported for movement on said upper surface.

14. The power module of claim 13 wherein said carriage is formed with a key and said base includes means defining a slot for receiving said key through said upper surface whereby said carriage may be guided in said movement.

15. The power module of claim 5 further comprising means defining a pair of slots in said base extending substantially parallel to said direction of carriage movement and aligned with said sockets to provide clearance for the mounting posts of tools mounted in said sockets whereby the mounting posts may pass through said base.

* * * * *